US008801916B2

(12) United States Patent
Lee et al.

(10) Patent No.: US 8,801,916 B2
(45) Date of Patent: Aug. 12, 2014

(54) RECOVERY METHOD OF NICKEL FROM SPENT ELECTROLESS NICKEL PLATING SOLUTIONS BY ELECTROLYSIS

(71) Applicant: Korea Institute of Science and Technology, Seoul (KR)

(72) Inventors: Hwa Young Lee, Seoul (KR); Byung Won Cho, Seoul (KR); Joong Kee Lee, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 13/670,869

(22) Filed: Nov. 7, 2012

(65) Prior Publication Data

US 2014/0097094 A1 Apr. 10, 2014

(30) Foreign Application Priority Data

Oct. 9, 2012 (KR) ..... 10-2012-0112038

(51) Int. Cl.
*C25C 1/08* (2006.01)
*C25C 3/34* (2006.01)
*C25C 7/00* (2006.01)

(52) U.S. Cl.
USPC ..... 205/595; 205/370; 205/548; 205/594; 205/720

(58) Field of Classification Search
CPC ..... C25C 1/08; C25C 3/34; C25C 7/00
USPC ..... 205/595, 365, 370, 548, 587, 594, 720
See application file for complete search history.

(56) References Cited

U.S. PATENT DOCUMENTS

| | | | | |
|---|---|---|---|---|
| 2,389,181 | A * | 11/1945 | Brown | 205/274 |
| 2,431,997 | A * | 12/1947 | Du Rose | 423/511 |
| 7,601,264 | B2 | 10/2009 | Golden et al. | |
| 2012/0298527 | A1 * | 11/2012 | James et al. | 205/743 |

OTHER PUBLICATIONS

C.L. Li, et al; "Recovery of spent electroless nickel plating bath by electrodialysis", Journal of Membrane Science, vol. 157, Dec. 9, 1998, pp. 241-249.

T. Püpel, et al; "Treatment of rinsing water from electroless nickel plating with a biologically active moving-bed sand filter", Hydrometallurgy, vol. 59, Accepted Mar. 24 2000, pp. 383-393.

* cited by examiner

*Primary Examiner* — Harry D Wilkins, III
*Assistant Examiner* — Zulmariam Mendez
(74) *Attorney, Agent, or Firm* — Ladas & Parry LLP

(57) ABSTRACT

A recovery method of nickel according to the present invention comprises pretreatment step to prepare a solution for electrolysis by adding hexanesulfonate salt to a treatment solution including nickel, and nickel recovery step to recover nickel in a metal form by electrolysis of the above solution for electrolysis. The present invention can produce nickel in high purity with simple process with low cost, and can recover and reproduce nickel in a metal form with at least 99.5% of high purity and at least 90% of recovery rate.

16 Claims, No Drawings

RECOVERY METHOD OF NICKEL FROM SPENT ELECTROLESS NICKEL PLATING SOLUTIONS BY ELECTROLYSIS

CROSS-REFERENCE TO RELATED APPLICATION

The present disclosure relates to subject matter contained in priority Korean Application No. 10-2012-0112038, filed on Oct. 9, 2012, which is herein expressly incorporated by reference in its entirety.

BACKGROUND OF THE INVENTION

1. Field of the Invention

The present invention relates to recovery method of nickel, and particularly to recovery method of nickel which can recover and reproduce nickel in a metal form from solutions prior to treatment such as spent electroless plating solutions by electrolysis.

2. Background of the Invention

Recently due to rapid development of domestic industries, cases of coating a metal layer to various material surfaces have increased in order to provide new functions such as corrosive prevention and conductivity or provide beautiful metal gloss. Metal plating process is one of important methods for the above metal coating, which has been used for much long time already and separate from the electroplating, application of electroless metal plating has continued to increase also.

As the electroless nickel plating has characteristics that it is possible to plate a nickel layer very evenly to the surface of non-conductive materials such as plastics, glasses, and ceramic materials and improve physical properties of the materials such as abrasion resistance, it is often applied to treatment of various materials for electro vehicle parts and electro-devices.

However, in case of the electroless plating, composition and ingredients of the plating solution is featured by getting further complicated than general electroplating, accordingly the spent electroless plating solution may cause serious environmental pollution. Especially, electroless nickel plating solution includes considerable amount of various organic acids and organic salts as complexing agents to produce complex compounds with nickel ions as well as sodium hypophosphite ($NaH_2PO_2$) used as a reducing agent, so these spent solution is more likely to cause environmental pollution.

As a treatment method of the spent electroless nickel plating solution, a method to add lime to the waste solution to remove various ions in the waste solution by making them precipitated as calcium salts has been mainly used. But the above precipitation method using lime has problems that not only is difficult to remove nickel completely but also produces large amount of sludge. In order to these demerits, oxidation methods using various oxidizing agents had been developed, but it has been reported that in that case, there were some problems in economic efficiency because of high price of the oxidizing agents.

In addition, the above mentioned conventional treatment methods of spent electroless plating solution have fundamental problems that they were developed simply for treatment of waste solution, so treat nickel, the available metal resource, simply as a waste and cannot recover and reproduce it as a product.

Methods to recover and reproduce nickel as a product from the electroless plating solution include a method to add alkali such as caustic soda to the waste solution to recover nickel by making it precipitated as nickel hydroxide and a method to recover nickel as metal form by electrolysis of the waste solution. The former has demerits that because very strong alkali solution over pH 14 is required to make the nickel stabilized as a complex compound precipitated as nickel hydroxide, the precipitated nickel hydroxide has very low purity from adulteration of phosphorus and various organic matters as impurities as well as requiring excessive amount of caustic soda. The latter to recover nickel by direct m electrolysis of the spent electroless plating solution has also a demerit that because nickel ions in the waste solution are combined stably with the complexing agent, electrodeposition of nickel is highly difficult in general electrolysis conditions.

SUMMARY OF THE INVENTION

An object of the present invention is to provide a method to recover nickel as a metal form with high purity in high recovery rate from solutions prior to treatment including nickel such as spent electroless nickel plating solution by direct electrolysis through simple and economic treatment process, and reproduce the recovered nickel as a product.

In order to achieve the above object, a recovery method of nickel according to an example of the present invention comprises, pretreatment step to prepare a solution for electrolysis by adding hexanesulfonate salt to a treatment solution including nickel; and nickel recovery step to recover nickel in a metal form by electrolysis of the solution for electrolysis.

The hexanesulfonate salt may include sodium hexanesulfonate.

The solution for electrolysis may include the nickel and the hexanesulfonate salt in 1:2~1:7 by mole ratio.

A cathode including tin may apply to the electrolysis.

The solution for electrolysis may be pH 4~5.

The electrolysis may be done in 5~20 $mA/cm^2$ of current density.

The treatment solution may be spent electroless plating solution or its concentrated solution.

The recovered nickel in a metal form may have at least 99.5% of purity.

The above recovery method of nickel may have at least 90% of nickel recovery rate.

DETAILED DESCRIPTION OF THE INVENTION

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

The treatment solution including nickel in the present invention, preferably may be spent electroless plating solution, but is not limited in it. Solutions that include nickel as a form of nickel ion or nickel complex compound and are used as a solution to recover nickel from it are sufficient to be applied to the treatment solution.

The recovery method of nickel in the present invention comprises pretreatment step and nickel recovery step.

The pretreatment step comprises a process to prepare a solution for electrolysis by adding hexanesulfonate salt to a treatment solution including nickel.

The hexanesulfonate salt acts as a de-complexing agent, which play a role in de-complexing nickel combined with complexing agent to a form of nickel ion.

In case of spent electroless plating solution, an example of the treatment solution, because nickel ions form and exist as highly stable complex compound with various organic acids acting as complexing agents, its electrodeposition on the surface of cathode hardly occurs with conventional electrolysis methods. However, passing through the above pretreatment step, it becomes possible to destroy the combination in the nickel complex compound and separate nickel ions due to the hexanesulfonate salt.

While other compounds acting as de-complexing agents may be used in the pretreatment step, the present invention applies the hexanesulfonate salt considering that it acts as a powerful de-complexing agent to the nickel complex compound.

Anything able to offer hexanesulfonate ion under the treatment solution may be sufficient to be applied for the above hexanesulfonate salt, and preferably the hexanesulfonate salt may be sodium hexanesulfonate.

The solution for electrolysis may include the nickel and the hexanesulfonate salt in 1:2 to 1:7 of mole ratio. When content of the hexanesulfonate salt is below 2 mole per 1 mole of nickel, nickel ions may not be de-complexed completely and when it exceeds 7 mole per 1 mole of nickel, chemical use may be increased unnecessarily.

The above nickel recovery step comprises a process to recover nickel in a form of metal by electrolysis of the solution for electrolysis.

For the above electrolysis, conventional electrolysis process of nickel is sufficient to be applied. Concretely, the electrolysis process may be done by adding the solution for electrolysis, which was prepared in the pretreatment step and includes de-complexed nickel ions, to an electrolysis bath equipped with a cathode and an anode.

The above solution for electrolysis may be pH 4 to 5. When the solution for electrolysis is below pH 4, the current efficiency may decrease. When it is over pH 5, nickel oxide instead of metal nickel may be deposited on the surface of cathode.

The electrolysis may be done in 5~20 mA/cm$^2$ of current density. When current density of the electrolysis is under 5 mA/cm$^2$, electrodeposition speed of nickel may decrease to reduce productivity, and when it is over 20 mA/cm$^2$, the current efficiency may decrease.

For materials of the anode, there is no specific limitation in the material, but preferably, a platinum electrode may be used. For materials of the cathode, an electrode including tin may be used and an electrode composed of tin may be used.

When other metal cathode is used as the cathode, nickel hydroxide may be generated and deposited on the surface of cathode in early stage of the electrolysis, so may result in a problem that the current efficiency decreases rapidly. However, if a tin electrode was used as the cathode, this problem would not occur and it is capable of electrodeposition of nickel with high purity in a metal form on the surface of cathode, so it is possible to recover and produce it as a product with a simple method.

The above recovered nickel in a metal form may have at least 99.5% of purity.

Recovery rate of the nickel may be at least 90%, when comparing between content of nickel included in the treatment solution and content of nickel recovered after electrolysis of the nickel recovery step, on the basis of weight.

The recovery method of nickel in the present invention can recover and reproduce nickel in a metal form with high purity and high recovery rate from the to solutions including nickel such as spent electroless plating solution. In addition, it is possible to treat solutions, highly difficult to treat prior to treatment such as spent electroless plating solution, using simple methods including pretreatment with hexanesulfonate salt and electrolysis of pretreated solution, so as to provide a recovery method of nickel which is very simple, economically efficient, and able to treat large amount of spent solutions. Furthermore, the purity of recovered nickel is very excellent as at least 99.5%, so it is possible to reproduce nickel in a metal form, and the recovery effect of nickel is also good as at least 90%.

The recovery method of nickel in the present invention can reproduce high purity nickel in a form of metal from solutions such as spent electroless plating solution with simple process and low cost, by using hexanesulfonate salt and electrolysis. Besides, while it is hardly possible to reproduce nickel in a metal form from solutions including nickel such as spent electroless plating solution with general electrolysis methods, it is possible to recover nickel in a metal form with at least 90% of recovery rate, using the recovery method of the present invention.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

Example 1

After putting 1 L of spent electroless nickel plating solution (a treatment solution including nickel including 4850 mg/L of Ni, 37 mg/L of Fe, and 24 mg/L of Zn) to a reactor, and adding sodium hexanesulfonate (SHS) as 2 mole per 1 mole of Ni to the treatment solution, and this was stirred sufficiently to prepare a is solution for electrolysis in Example 1 (Pretreatment step).

After adjusting the solution for electrolysis in the Example 1 to pH 4, filling it into a electrolysis bath, and installing platinum (Pt) as an anode and tin (Sn) as a cathode to it, electrolysis was performed at 20 mA/cm$^2$ of current density with a constant current power supply for 2 hr. 4490 mg of the nickel in a metal form electrodeposited and was recovered on the cathode during the above electrolysis (nickel recovery step).

Purity analysis results of the above recovered nickel were shown in below Table 1.

TABLE 1

| Element | Fe | Zn | Ni | Total |
|---|---|---|---|---|
| Content (weight %) | 0.19 | 0.23 | 99.58 | 100 |

As shown in the above Table 1, the purity of nickel recovered by the Example 1 was 99.58%. In addition, it was found that the recovery rate of nickel obtained was 92.6% by comparing the amount of nickel included in the early spent electroless plating solution with the amount of recovered nickel on the basis of weight.

Example 2

Same to the above Example 1, after putting 1 L of spent electroless nickel plating solution (solution prior to treatment including 4850 mg/L of Ni, 37 mg/L of Fe, and 24 mg/L of Zn) to a reactor and adding sodium hexanesulfonate (SHS) as 7 mole per 1 mole of Ni to the treatment solution, and this was stirred sufficiently to prepare a solution for electrolysis in Example 2 (Pretreatment step).

After adjusting the solution for electrolysis in the Example 2 to pH 5, filling it into a electrolysis bath, and installing platinum (Pt) as an anode and tin (Sn) as a cathode to it, electrolysis was performed at 5 mA/cm$^2$ of current density with a constant current power supply for 8 hr. 4,550 mg of the nickel in a metal form electrodeposited on the cathode during the above electrolysis, was recovered (nickel recovery step).

Purity analysis results of the above recovered nickel were shown in below Table 2.

TABLE 2

| Element | Fe | Zn | Ni | Total |
|---|---|---|---|---|
| Content (weight %) | 0.11 | 0.16 | 99.73 | 100 |

As shown in the above Table 2, the purity of nickel recovered by the Example 2 was 99.73%. In addition, it was found that the recovery rate of nickel obtained was 93.8% by comparing the amount of nickel included in the early spent electroless plating solution with the amount of recovered nickel on the basis of weight.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A nickel recovery method comprising:

adding hexanesulfonate salt to a treatment solution that comprises ionic nickel such that a mole ratio of the ionic nickel and the hexanesulfonate salt is between about 1:2 to about 1:7;

adjusting a pH of the treatment solution with the added hexanesulfonate salt to be between a pH of about 4 to about 5;

installing an anode and a cathode into the treatment solution with the added hexanesulfonate salt;

electrolyzing the treatment solution with the added hexanesulfonate salt to reduce the ionic nickel to metallic nickel on the cathode wherein the metallic nickel comprises a purity of at least 99.5%.

2. The nickel recovery method of claim 1, wherein the hexanesulfonate salt comprises sodium hexanesulfonate.

3. The nickel recovery method of claim 1, wherein the mole ratio of the ionic nickel and the hexanesulfonate salt is about 1:2.

4. The nickel recovery method of claim 1, wherein the cathode comprises tin.

5. The nickel recovery method of claim 1, wherein the adjusted pH is about 4.

6. The nickel recovery method of claim 1, wherein the electrolysis is performed at a current density of about 5~20 mA/cm$^2$.

7. The nickel recovery method of claim 1, wherein the anode comprises platinum.

8. The nickel recovery method of claim 1, wherein the metallic nickel has at least a 99.7% purity.

9. The nickel recovery method of claim 1, wherein at least 90% of the ionic nickel in the solution is recovered as the metallic nickel from the treatment solution.

10. The nickel recovery method of claim 1, wherein the treatment solution comprises a spent electroless plating solution.

11. A nickel recovery method comprising:

adding hexanesulfonate salt into a spent electroless nickel plating solution so that a mole ratio of ionic nickel in the spent electroless nickel plating solution and the hexanesulfonate salt is between about 1:2 to about 1:7;

adjusting a pH of the spent electroless nickel plating solution with the added hexanesulfonate salt so that the pH is between about 4 to about 5;

installing an anode and a cathode into the spent electroless nickel plating solution with the added hexanesulfonate salt;

reducing the ionic nickel in the spent electroless nickel plating solution with the added hexanesulfonate salt into metallic nickel onto the cathode in which the metallic nickel comprises a purity of at least 99.5%.

12. The nickel recovery method of claim 11, further comprising:

putting the spent electroless nickel plating solution into a reactor prior to adding the hexanesulfonate salt into the spent electroless nickel plating solution.

13. The nickel recovery method of claim 11, wherein the cathode comprises tin and the anode comprises platinum.

14. The nickel recovery method of claim 11, wherein the reduction of the ionic nickel into metallic nickel is performed at a current density of about 5~20 mA/cm$^2$.

15. The nickel recovery method of claim 11, wherein the metallic nickel is at least 99.7% pure.

16. The nickel recovery method of claim 11, wherein at least 90% of the ionic nickel from the spent electroless nickel plating solution is recovered as the metallic nickel reduced on the cathode.

* * * * *